US012295418B2

(12) United States Patent
Lee et al.

(10) Patent No.: US 12,295,418 B2
(45) Date of Patent: May 13, 2025

(54) AEROSOL GENERATING DEVICE

(71) Applicant: KT&G CORPORATION, Daejeon (KR)

(72) Inventors: Won Kyeong Lee, Gyeonggi-do (KR); Heon Jun Jeong, Seoul (KR); Dong Sung Kim, Seoul (KR); Jae Sung Choi, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 304 days.

(21) Appl. No.: 17/787,862

(22) PCT Filed: Oct. 5, 2021

(86) PCT No.: PCT/KR2021/013616
§ 371 (c)(1),
(2) Date: Jun. 21, 2022

(87) PCT Pub. No.: WO2022/119099
PCT Pub. Date: Jun. 9, 2022

(65) Prior Publication Data

US 2023/0033764 A1 Feb. 2, 2023

(30) Foreign Application Priority Data

Dec. 3, 2020 (KR) ..... 10-2020-0167667

(51) Int. Cl.
*A24F 40/485* (2020.01)
*A24F 7/00* (2006.01)
(Continued)

(52) U.S. Cl.
CPC ..... *A24F 40/485* (2020.01); *A24F 7/00* (2013.01); *A24F 40/10* (2020.01); *A24F 40/50* (2020.01)

(58) Field of Classification Search
CPC ..... A24F 40/485; A24F 7/00; A24F 40/10; A24F 40/50; A24F 40/40; A24F 40/42; A24F 40/46; A24F 40/51; A24F 40/85
See application file for complete search history.

(56) References Cited

U.S. PATENT DOCUMENTS 6,234,169 B1 5/2001 Bulbrook et al.
10,188,145 B2 1/2019 Rado
(Continued)

FOREIGN PATENT DOCUMENTS

CA 2271404 A1 11/2000
CN 206251933 U 6/2017
(Continued)

OTHER PUBLICATIONS

International Search Report of PCT/KR2021/013616 dated Jan. 14, 2022 [PCT/ISA/210].
(Continued)

*Primary Examiner* — Edwin A. Leon
(74) *Attorney, Agent, or Firm* — Sughrue Mion, PLLC

(57) ABSTRACT

An aerosol generating device includes: an aerosol generating material reservoir configured to store an aerosol generating material; an atomizer configured to atomize the aerosol generating material into an aerosol; an inflow passage configured to provide fluid communication between outside of the aerosol generating device and the atomizer; a discharge passage which is surrounded by a passage wall and through which air introduced from the outside through the inflow passage and the aerosol are discharged out of the aerosol generating device; and at least one convex surface configured to guide the aerosol to the outside of the aerosol generating device by Coanda effect, so that the discharge rate of the aerosol may be enhanced and liquefaction of the aerosol in the airflow passage may be minimized.

18 Claims, 10 Drawing Sheets

(51) Int. Cl.
*A24F 40/10* (2020.01)
*A24F 40/50* (2020.01)

(56) References Cited

U.S. PATENT DOCUMENTS

| | | | | |
|---|---|---|---|---|
| 10,300,228 | B2 | 5/2019 | Minskoff | |
| 10,441,734 | B2 * | 10/2019 | Hearn | A61M 15/0021 |
| 10,602,781 | B2 | 3/2020 | Nakano et al. | |
| 11,197,497 | B2 | 12/2021 | Lee et al. | |
| 2016/0228658 | A1 | 8/2016 | Minskoff | |
| 2018/0000159 | A1 * | 1/2018 | Rogan | A61M 11/06 |
| 2018/0014574 | A1 | 1/2018 | Rogan | |
| 2018/0027875 | A1 | 2/2018 | Rostami et al. | |
| 2019/0254350 | A1 | 8/2019 | Lord | |
| 2019/0274360 | A1 | 9/2019 | Liu et al. | |
| 2019/0314586 | A1 | 10/2019 | Minskoff | |
| 2020/0138112 | A1 | 5/2020 | Atkins et al. | |
| 2020/0187559 | A1 | 6/2020 | Nakano et al. | |
| 2020/0205478 | A1 | 7/2020 | Dick et al. | |
| 2021/0022391 | A1 | 1/2021 | Minami et al. | |
| 2021/0106051 | A1 | 4/2021 | Han et al. | |

FOREIGN PATENT DOCUMENTS

| | | | |
|---|---|---|---|
| CN | 107205496 | A | 9/2017 |
| CN | 207692969 | U | 8/2018 |
| CN | 208480613 | U | 2/2019 |
| CN | 110623313 | A | 12/2019 |
| CN | 110891435 | A | 3/2020 |
| CN | 111387543 | A | 7/2020 |
| EP | 2967137 | A2 | 1/2016 |
| EP | 3 741 230 | A1 | 11/2020 |
| EP | 4 056 058 | A1 | 9/2022 |
| JP | 47-14743 | A | 9/1972 |
| JP | 2017-526503 | A | 9/2017 |
| JP | 2020-511998 | A | 4/2020 |
| KR | 10-2015-0036557 | A | 4/2015 |
| KR | 10-2018-0058722 | A | 6/2018 |
| KR | 10-2018-0111460 | A | 10/2018 |
| KR | 10-2019-0062578 | A | 6/2019 |
| KR | 10-2019-0097297 | A | 8/2019 |
| KR | 10-2020-0098028 | A | 8/2020 |
| WO | 2014/140273 | A3 | 9/2014 |
| WO | 2016/124741 | A1 | 8/2016 |
| WO | 2019/003116 | A1 | 1/2019 |
| WO | 2019/121684 | A1 | 6/2019 |
| WO | 2019/198688 | A1 | 10/2019 |
| WO | 2020115151 | A1 | 6/2020 |
| WO | 2020/200647 | A1 | 10/2020 |

OTHER PUBLICATIONS

Written Opinion of PCT/KR2021/013616 dated Jan. 14, 2022 [PCT/ISA/237].

Extended European Search Report dated Nov. 17, 2022 from the European Patent Office in EP Application No. 21900787.9.

Office Action dated Nov. 28, 2022 from the Korean Intellectual Property Office in KR application No. 10-2020-0167667.

Japanese Office Action dated Aug. 8, 2023 in Application No. 2022-539251.

The First Office Action issued in The State Intellectual Property Office of People's Republic of China on Mar. 31, 2025 in corresponding CN Patent Application No. 202180007596.6.

* cited by examiner

[Fig. 1]
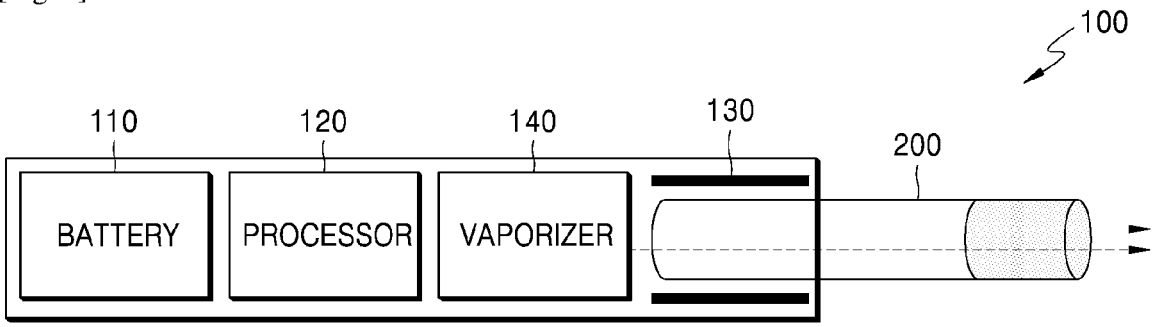
[Fig. 2]
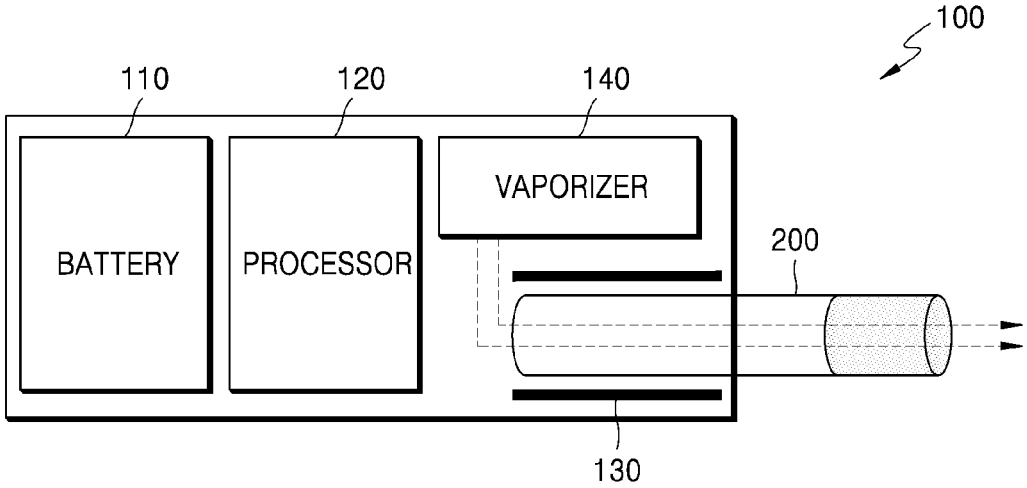
[Fig. 3]
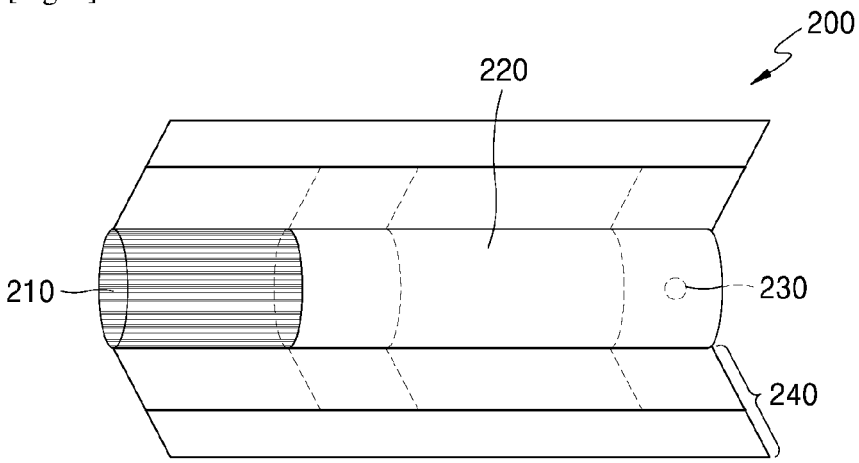

[Fig. 4]
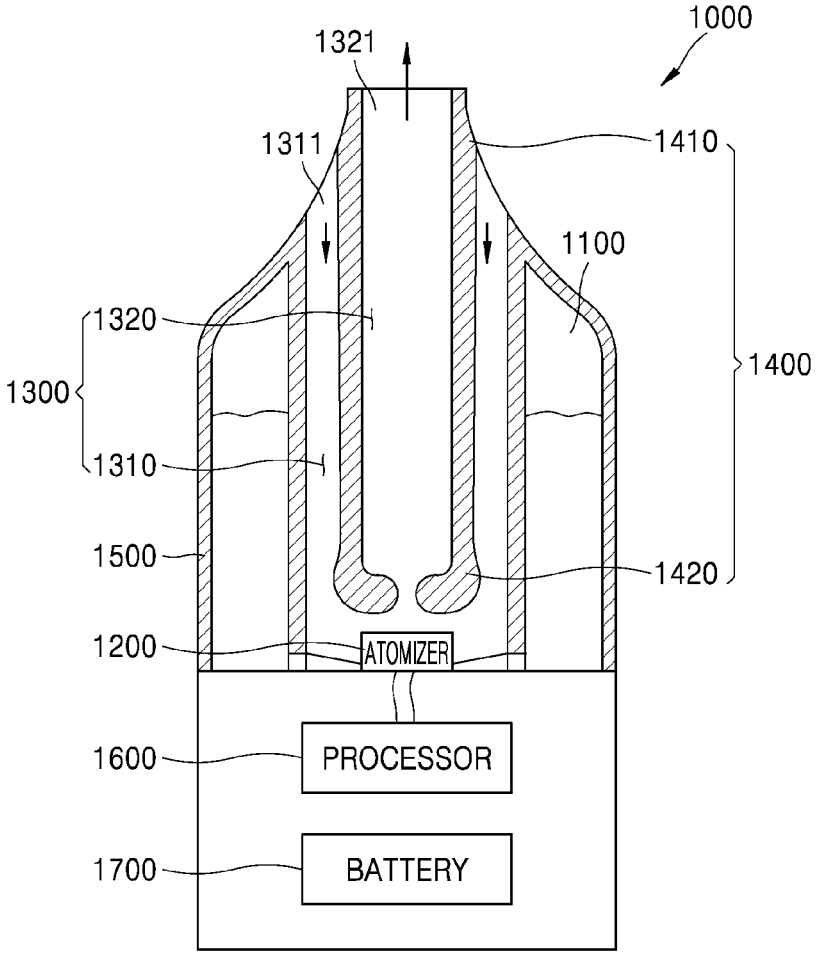

[Fig. 5]
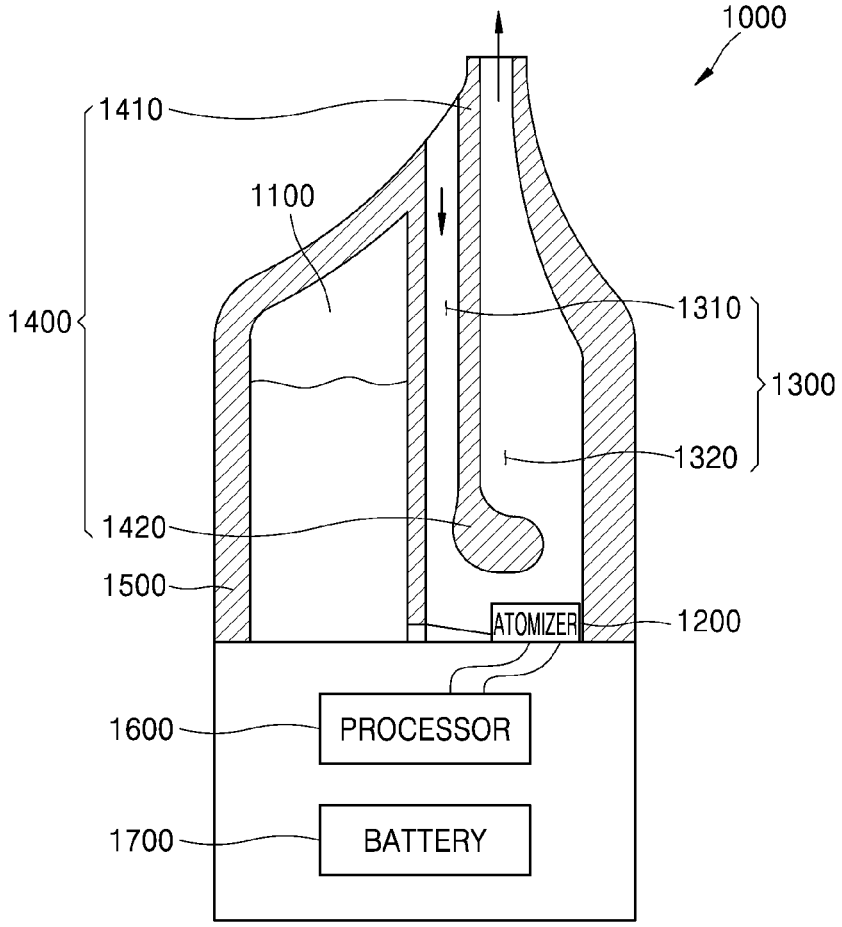

[Fig. 6A]
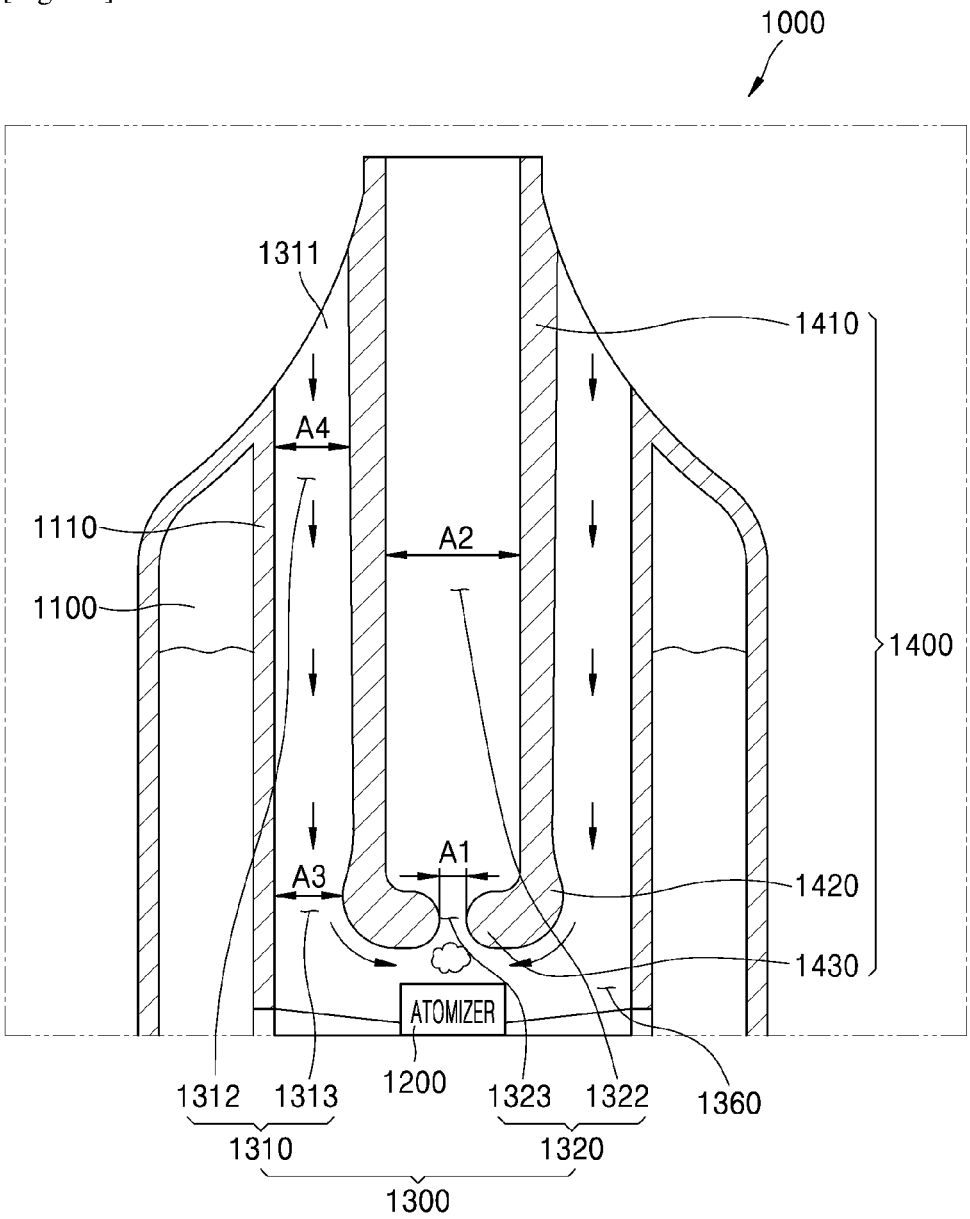

[Fig. 6B]
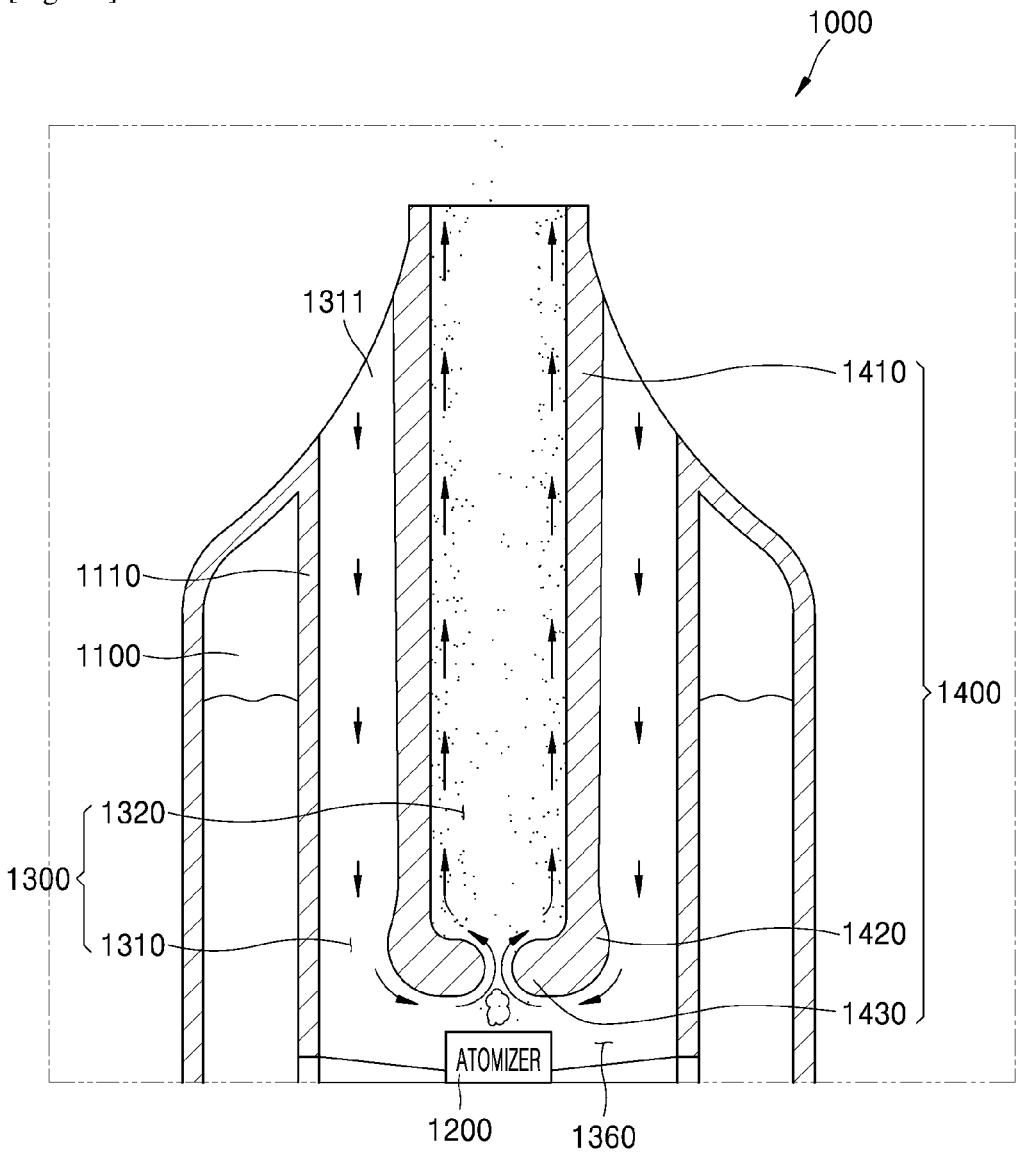

[Fig. 7]
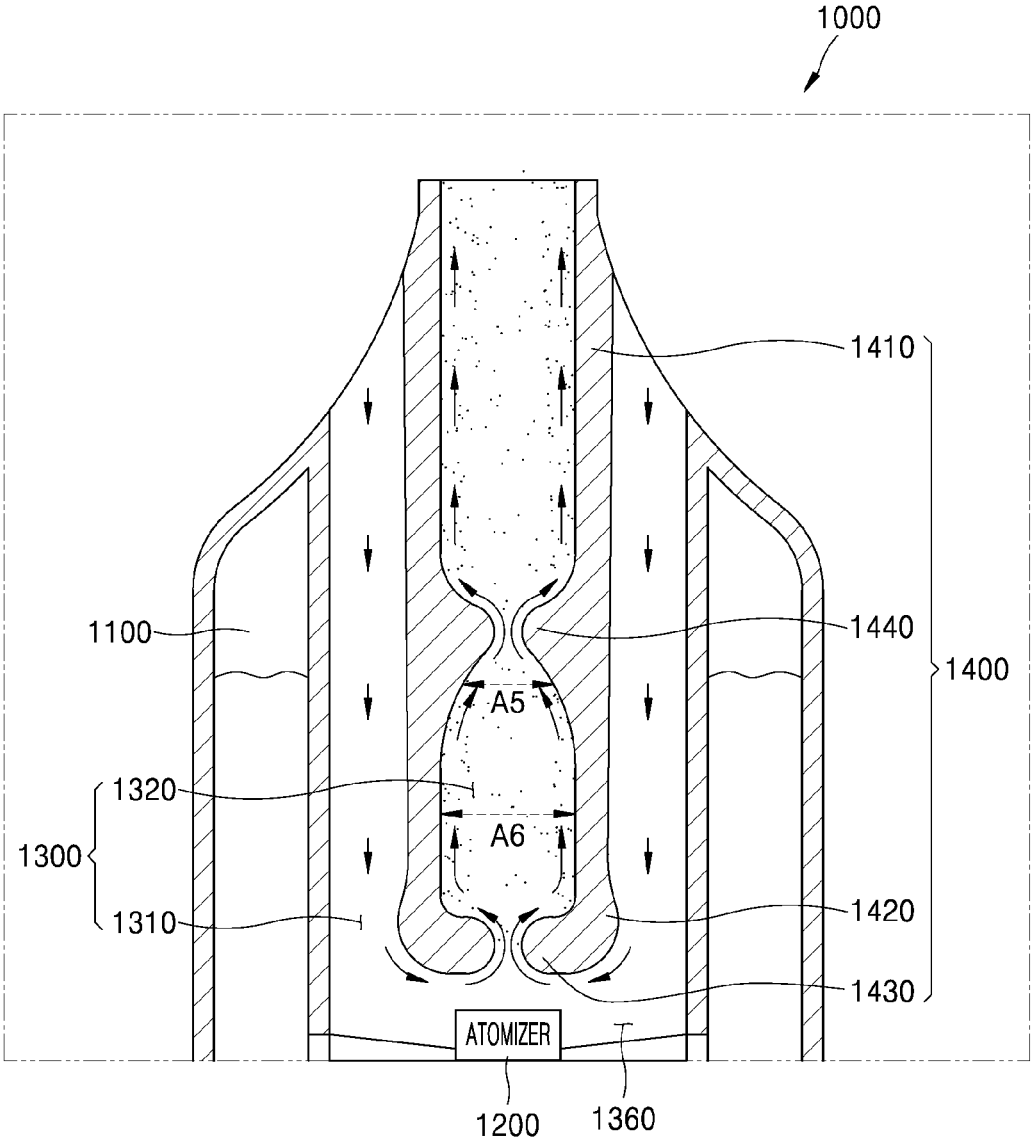

[Fig. 8]
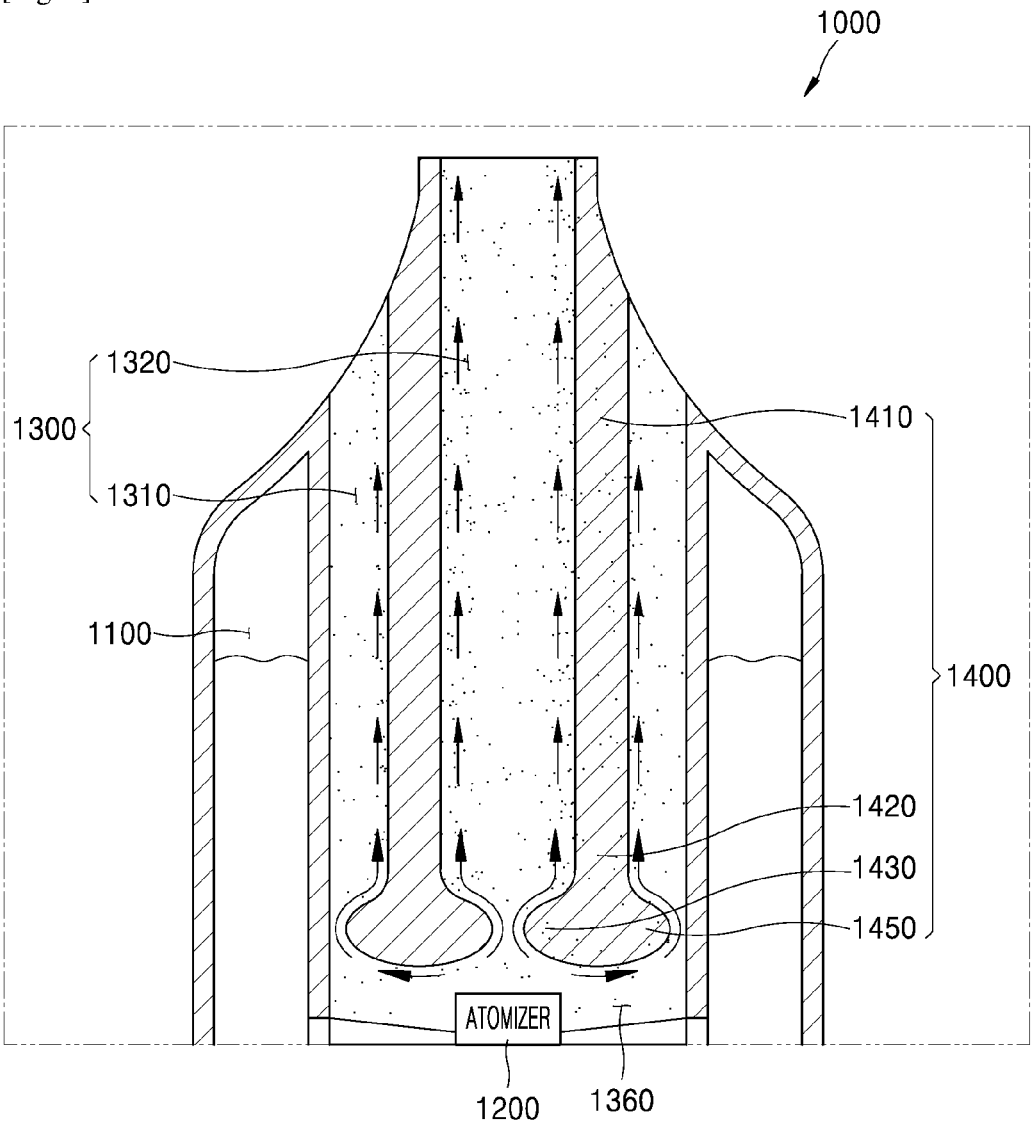

[Fig. 9]
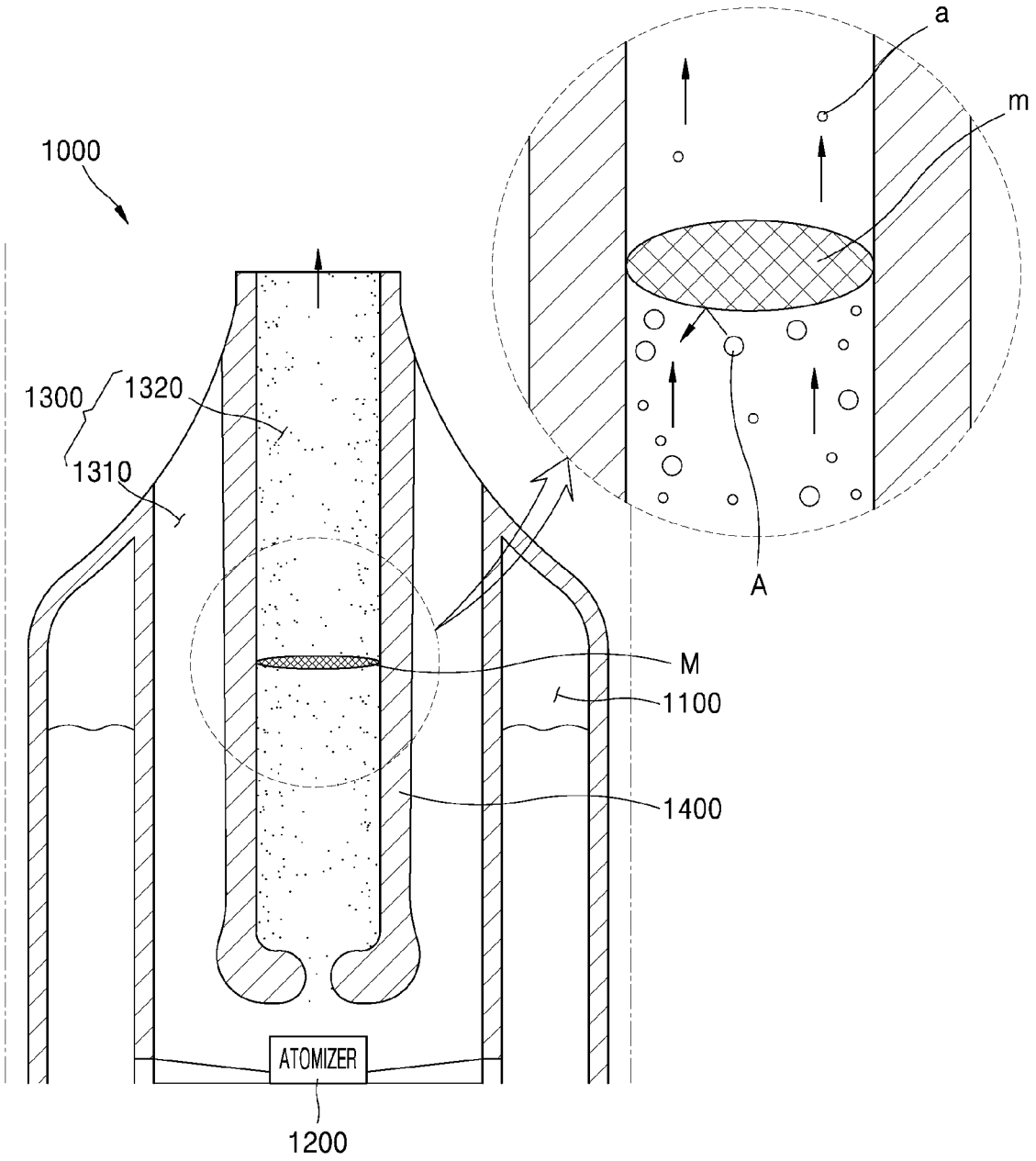

[Fig. 10]
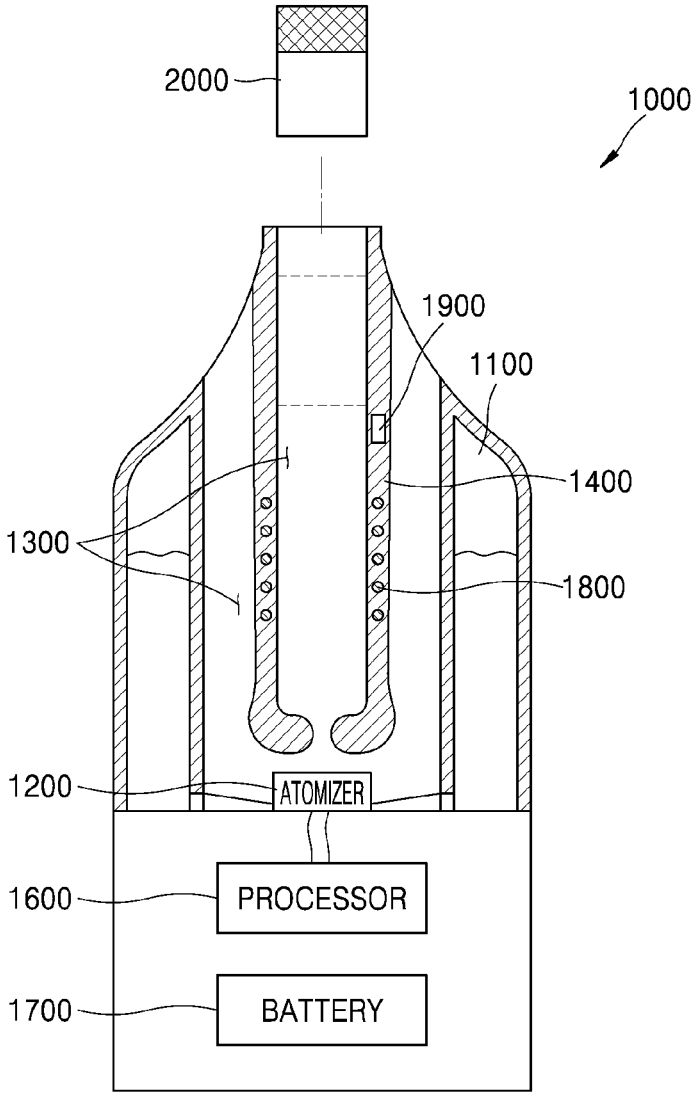

[Fig. 11]
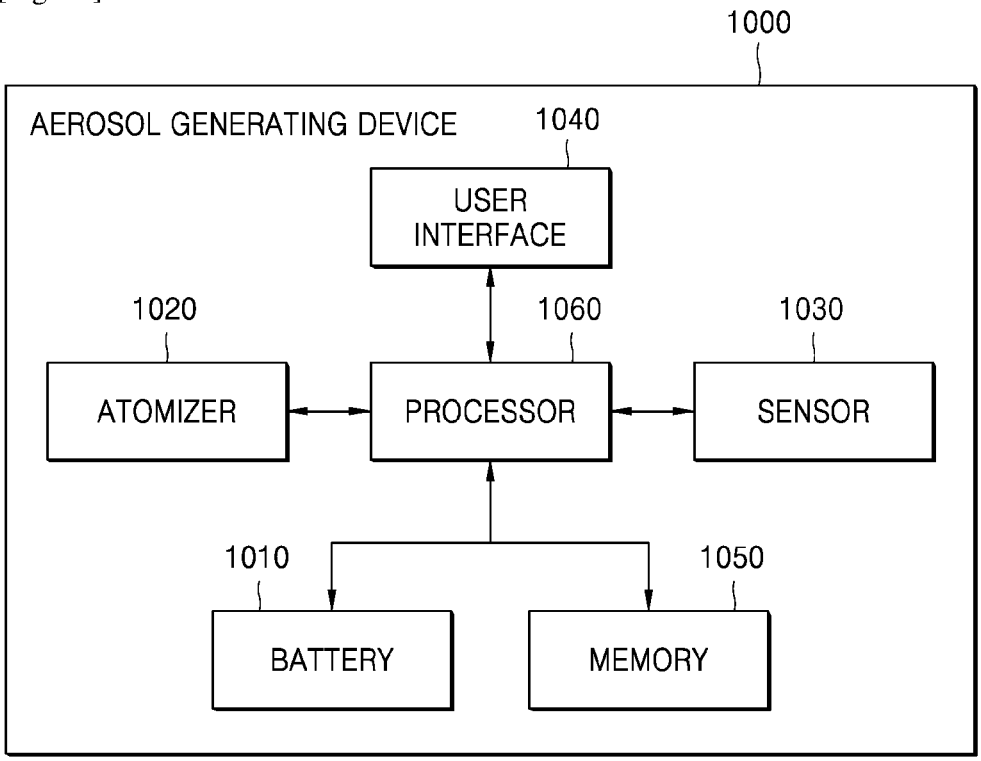

AEROSOL GENERATING DEVICE

CROSS REFERENCE TO RELATED APPLICATIONS

This application is a National Stage of International Application No. PCT/KR2021/013616 filed on Oct. 5, 2021, claiming priority based on Korean Patent Application No. 10-2020-0167667 filed on Dec. 3, 2020.

TECHNICAL FIELD

One or more embodiments of the present disclosure relate to an aerosol generating device, and more particularly, to an aerosol generating device having a structure in which an aerosol generated inside the aerosol generating device may be quickly discharged to the outside.

BACKGROUND ART

There is growing demand for aerosol-generating devices which generate aerosols in a non-combusting manner as an alternative to traditional combustive cigarettes. An aerosol-generating device may generate an aerosol in a non-combusting manner from an aerosol-generating material to a user. Also, some aerosol-generating devices may generate an aerosol having a flavor by passing a vapor generated from the aerosol-generating material through a fragrance medium.

The aerosol generating material used in the aerosol generating device may be in a solid state, such as a cigarette, a flowing liquid state, or a gel state. The aerosol generating material may be stored in an aerosol generating material reservoir inside the aerosol generating device, or in a cartridge that is used in combination with the aerosol generating device. When the aerosol generating material is exhausted, the aerosol generating material may be refilled into the aerosol generating material reservoir, or a new cartridge may be replaced so that the aerosol generating device can be continuously used.

DISCLOSURE OF INVENTION

Technical Problem

The aerosol may be liquefied and/or agglomerated before the aerosol is discharged to the outside of the aerosol generating device. Since the liquefied and/or agglomerated aerosol has adhesiveness, the aerosol may be adhered or accumulated in the aerosol generating device, which may degrade the durability of the aerosol generating device and the user's smoking satisfaction.

The problems to be solved by the embodiments are not limited to the above-described problems, and undescribed problems may be clearly understood by those skilled in the art to which the present disclosure belongs from the present specification and the accompanying drawings.

Solution to Problem

An aerosol generating device according to an embodiment may include an aerosol generating material configured to store an aerosol generating material; an atomizer configured to atomize the aerosol generating material into an aerosol; an inflow passage configured to provide fluid communication between outside of the aerosol generating device and the atomizer; a discharge passage which is surrounded by a passage wall and through which air introduced from the outside through the inflow passage and the aerosol are discharged out of the aerosol generating device; and at least one convex surface configured to guide the aerosol to the outside of the aerosol generating device by Coanda effect, and comprising a first convex surface protruding toward the discharge passage from the passage wall.

Advantageous Effects of Invention

According to an aerosol generating device according to an embodiment, the discharge rate of an aerosol may be enhanced so that the amount of atomization of the aerosol generating device may be increased and liquefaction of the aerosol in an airflow passage may be minimized.

Also, even when the aerosol generating device is not in use, the aerosol generated by the residual heat of an atomizer is guided to the outside of the aerosol generating device so that the inside of the aerosol generating device may be maintained clean.

Effects of the embodiments are not limited to the above-described effects, and undescribed effects will be clearly understood by those skilled in the art to which the present disclosure belongs from the present specification and the accompanying drawings.

BRIEF DESCRIPTION OF DRAWINGS

FIG. 1 is a drawing illustrating an example in which a cigarette is inserted into an aerosol generating device according to an embodiment;

FIG. 2 is a drawing illustrating an example in which a cigarette is inserted into an aerosol generating device according to another embodiment;

FIG. 3 is a drawing illustrating an example of a cigarette;

FIG. 4 is a cross-sectional view of an aerosol generating device according to an embodiment;

FIG. 5 is a cross-sectional view of an aerosol generating device according to another embodiment;

FIG. 6A is an enlarged cross-sectional view illustrating an airflow passage so as to describe the flow of an airflow in the aerosol generating device according to the embodiment shown in FIG. 4;

FIG. 6B is an enlarged cross-sectional view illustrating an airflow passage so as to describe the flow of an airflow in the aerosol generating device according to the embodiment shown in FIG. 4;

FIG. 7 is an enlarged cross-sectional view of an aerosol generating device according to another embodiment;

FIG. 8 is an enlarged cross-sectional view of an aerosol generating device according to another embodiment;

FIG. 9 is an enlarged view illustrating a mesh net arranged in an aerosol generating device according to an embodiment;

FIG. 10 is a cross-sectional view of an aerosol generating device according to another embodiment; and FIG. 11 is a block diagram illustrating an aerosol generating device according to an embodiment.

BEST MODE FOR CARRYING OUT THE INVENTION

An aerosol generating device according to one or more embodiments includes an aerosol generating material configured to store an aerosol generating material; an atomizer configured to atomize the aerosol generating material into an aerosol; an inflow passage configured to provide fluid communication between outside of the aerosol generating device and the atomizer; a discharge passage which is surrounded by a passage wall and through which air introduced from the outside through the inflow passage and the aerosol are discharged out of the aerosol generating device; and at least one convex surface configured to guide the aerosol to the outside of the aerosol generating device by Coanda effect, and comprising a first convex surface protruding toward the discharge passage from the passage wall.

The passage wall may extend from one end thereof to the other end thereof in a longitudinal direction of the aerosol generating device, and the first convex surface may be formed at an upstream end of the passage wall.

The at least one convex surface may further include a second convex surface positioned apart from the first convex surface and protruding from the passage wall toward the discharge passage.

The passage wall may extend in a longitudinal direction of the aerosol generating device, and the second convex surface may be positioned downstream of the first convex surface.

The at least one convex surface may further include a third convex surface protruding from the passage wall toward the inflow passage.

The passage wall may extend in a longitudinal direction of the aerosol generating device, and the third convex surface may be formed at an upstream end of the passage wall.

The inflow passage may be located between the aerosol generating material reservoir and the passage wall.

The aerosol generating device may further include a housing that includes: an inflow hole through which outside air is introduced; and a discharge hole through which the generated aerosol is discharged.

The aerosol generating device may further include a mouthpiece for contacting a user's mouth, and the mouthpiece may be in fluid communication with the discharge passage.

Without user's inhalation, an aerosol generated by the atomizer may be guide to the outside of the aerosol generating device along at least one of the first convex surface and the third convex surface.

The aerosol generating device may further include a heating member located in the passage wall and configured to heat the aerosol present in the discharge passage.

The aerosol generating device may further include a puff detection sensor configured to detect user's inhalation and a processor electrically connected to the heating member and the puff detection sensor, and configured to control the heating member to be heated for a certain time based on the user's inhalation being detected by the puff detection sensor.

The discharge passage may be configured to receive an aerosol generating article such that the aerosol generating article is inserted into at least a portion of the discharge passage.

The aerosol generating device may further include a heater located in the discharge passage and configured to heat the aerosol generating article inserted into the discharge passage.

The aerosol generating device may further include a mesh net located in the discharge passage and configured to prevent passage of an aerosol particle greater than or equal to a certain size.

MODE FOR THE INVENTION

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. Also, in a special case, there may be terms that are arbitrarily selected by the applicant. In this case, the meanings of the terms will be described in detail in the description of the present disclosure. Thus, the terms used herein will be defined based on not simply the names of the terms but the meanings thereof and contents of the present disclosure.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

If one component or layer is mentioned to be "over," "above," "connected to," or "combined with" another component or layer, the one component or layer is arranged to be over, above, connected to, or combined with the other component or layer with or without an intervening component(s) or layer(s). In contrast, if one component or layer is mentioned to be "directly over," "directly above," "directly connected to," or "directly combined with" another component or layer, there is no additional components or layers between the components or layers. In the disclosure, the same reference numbers may indicate the same components.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

In addition, terms including ordinal numbers such as "first" or "second" used in the present specification may be used to describe various components, but the components should not be limited by the terms. Terms are used only for the purpose of distinguishing one component from another component.

In addition, some of components in the drawings may be illustrated to be somewhat exaggerated in size or ratio. In addition, components illustrated in some drawings may not be illustrated in other drawings.

In addition, the "longitudinal direction" of a component throughout the specification may be a direction in which the component extends along one axis, and in this case, one axis of the component may mean a direction in which the component extends longer than in other axes crossing the one axis. For example, the longitudinal direction may mean a direction parallel to the inflow direction or the discharge direction of the airflow shown in FIG. 6B.

The term "downstream" may refer to a direction in which the aerosol moves toward the mouth of a user in the aerosol generating article (e.g., cigarette or cartridge) during smoking, and the term "upstream" refers to its opposite direction.

The terms "downstream" and "upstream" may be used to indicate relative positions of components of the aerosol generating article. In this respect, a portion of a cigarette that is put in the user's mouth corresponds to a downstream end of the cigarette. For example, the upstream of a discharge passage in FIG. 6B may be a position adjacent to an atomization space, and the downstream of a discharge passage may be a position adjacent to a discharge hole.

In addition, the term "puff" throughout the specification may refer to user's act of inhaling the aerosol into the user's mouth, nasal cavity, and lungs.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Throughout the specification, the "embodiments" are arbitrary divisions for easily describing the invention in the present disclosure, and each of the embodiments need not be mutually exclusive. For example, the configurations disclosed in one embodiment may be applied and implemented in other embodiments, and at this time, they may be changed, applied, and implemented without departing from the scope of the present disclosure.

Also, the terms used in the present disclosure are for the purpose of describing embodiments and are not intended to limit the present embodiments. In the present disclosure, the singular form includes the plural form unless otherwise specified.

Hereinafter, the present disclosure will be described in detail with reference to the drawings.

FIGS. 1 and 2 are diagrams showing examples in which a cigarette is inserted into an aerosol generating device.

Referring to FIGS. 1 and 2, an aerosol generating device 100 may include a battery 110, a processor 120, a heater 130, and a vaporizer 140. Also, the cigarette 200 may be inserted into an inner space of the aerosol generating device 100.

The aerosol generating device 100 illustrated in FIGS. 1 and 2 includes the vaporizer 140. However, the embodiments are not limited to the implementation method thereof, and the vaporizer 140 may be omitted. In case the vaporizer 140 is omitted from the aerosol generating device 100, the cigarette 200 contains an aerosol generating material, so that the cigarette 200 generates an aerosol when the cigarette 200 is heated by the heater 130.

Contrary, the heater 130 and/or the cigarette 200 may be omitted from the aerosol generating device 100. In this case, the aerosol generating material included in the vaporizer 140 may be atomized by a heating element or vibrator, and an aerosol may be generated from the vaporizer 140.

FIGS. 1 and 2 illustrate components of the aerosol generating device 100, which are related to the present embodiment. Therefore, it will be understood by one of ordinary skill in the art related to the present embodiment that other general-purpose components may be further included in the aerosol generating device 100, in addition to the components illustrated in FIGS. 1 and 2.

Also, FIGS. 1 and 2 illustrate that the aerosol generating device 100 includes the heater 130. However, as necessary, the heater 130 may be omitted.

FIG. 1 illustrates that the battery 110, the processor 120, the vaporizer 140, and the heater 130 are arranged in series. Also, FIG. 2 illustrates that the vaporizer 140 and the heater 130 are arranged in parallel. However, the internal structure of the aerosol generating device 100 is not limited to the structures illustrated in FIG. 1 or FIG. 2. In other words, according to the design of the aerosol generating device 100, the battery 110, the processor 120, the vaporizer 140, and the heater 130 may be differently arranged.

When the cigarette 200 is inserted into the aerosol generating device 100, the aerosol generating device 100 may operate the vaporizer 140 to generate aerosol from the vaporizer 140. The aerosol generated by the vaporizer 140 is delivered to the user by passing through the cigarette 200. The vaporizer 140 will be described in more detail later.

The battery 110 may supply power to be used for the aerosol generating device 100 to operate. For example, the battery 110 may supply power to heat the heater 130 or the vaporizer 140, and may supply power for operating the processor 120. Also, the battery 110 may supply power for operations of a display, a sensor, a motor, etc. mounted in the aerosol generating device 100.

The processor 120 may generally control operations of the aerosol generating device 100. In detail, the processor 120 may control not only operations of the battery 110, the heater 130, and the vaporizer 140, but also operations of other components included in the aerosol generating device 100. Also, the processor 120 may check a state of each of the components of the aerosol generating device 100 to determine whether or not the aerosol generating device 100 is able to operate.

The processor 120 may include one or more components. For example, the processor 120 can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 130 may be heated by the power supplied from the battery 110. For example, when the cigarette 200 is inserted into the aerosol generating device 100, the heater 130 may be located outside the cigarette. Thus, the heated heater 130 may increase a temperature of an aerosol generating material in the cigarette.

The heater 130 may include an electro-resistive heater. For example, the heater 130 may include an electrically conductive track, and the heater 130 may be heated when currents flow through the electrically conductive track. However, the heater 130 is not limited to the example described above and may include any other heaters which may be heated to a desired temperature. Here, the desired temperature may be pre-set in the aerosol generating device 100 or may be set by a user.

As another example, the heater 130 may include an induction heater. In detail, the heater 130 may include an electrically conductive coil for heating an aerosol generating article in an induction heating method, and the aerosol generating article may include a susceptor which may be heated by the induction heater.

FIGS. 1 and 2 illustrate that the heater 130 is positioned outside the cigarette 200, but the position of the cigarette 200 is not limited thereto. For example, the heater 130 may include a tube-type heating element, a plate-type heating element, a needle-type heating element, or a rod-type heating element, and may heat the inside or the outside of the cigarette 200, according to the shape of the heating element.

Also, the aerosol generating device 100 may include a plurality of heaters 130. Here, the plurality of heaters 130 may be inserted into the cigarette 200 or may be arranged outside the cigarette 200. Also, some of the plurality of heaters 130 may be inserted into the cigarette 200, and the others may be arranged outside the cigarette 200. In addition, the shape of the heater 130 is not limited to the shapes illustrated in FIGS. 1 and 2 and may include various shapes.

The vaporizer 140 may generate aerosol by heating a liquid composition and the generated aerosol may pass through the cigarette 200 to be delivered to a user. In other words, the aerosol generated via the vaporizer 140 may move along an air flow passage of the aerosol generating device 100 and the air flow passage may be configured such that the aerosol generated via the vaporizer 140 passes through the cigarette to be delivered to the user.

For example, the vaporizer 140 may include a liquid storage, a liquid delivery element, and an atomizer (e.g., heating element and/or vibrator), but it is not limited thereto. For example, the liquid storage, the liquid delivery element, and the atomizer may be included in the aerosol generating device 100 as independent modules.

The liquid storage may store a liquid composition which is a kind of aerosol generating material. For example, the liquid composition may be a liquid including a tobacco-containing material having a volatile tobacco flavor component, or a liquid including a non-tobacco material. The liquid storage may be formed to be detachable from the vaporizer 140 or may be formed integrally with the vaporizer 140.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the atomizer. For example, the liquid delivery element may be a wick such as cotton fiber, ceramic fiber, glass fiber, or porous ceramic, but is not limited thereto.

As an example of an atomizer, the heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 140 may be referred to as a cartridge or a cartomizer, but it is not limited thereto.

The aerosol generating device 100 may further include general-purpose components in addition to the battery 110, the processor 120, and the heater 130. For example, the aerosol generating device 100 may include a display capable of outputting visual information and/or a motor for outputting haptic information.

The cigarette 200 may be similar to a general combustive cigarette. For example, the cigarette 200 may be divided into a first portion including an aerosol generating material and a second portion including a filter, etc. Alternatively, the second portion of the cigarette 200 may also include an aerosol generating material. For example, an aerosol generating material made in the form of granules or capsules may be inserted into the second portion.

The first portion may be completely inserted into the aerosol generating device 100, and the second portion may be exposed to the outside. Alternatively, only a portion of the first portion may be inserted into the aerosol generating device 100, or a portion of the first portion and a portion of the second portion may be inserted thereinto. The user may puff the aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 100. For example, opening and closing of the air passage and/or a size of the air passage formed in the aerosol generating device 100 may be adjusted by the user. Accordingly, the amount of smoke and a smoking impression may be adjusted by the user. As another example, the external air may flow into the cigarette 200 through at least one hole formed in a surface of the cigarette 200.

Hereinafter, an example of the cigarette 200 will be described with reference to FIG. 3.

FIG. 3 is a drawing illustrating an example of a cigarette.

Referring to FIG. 3, the cigarette 200 includes a tobacco rod 210 and a filter rod 220. The first portion described above with reference to FIGS. 1 and 2 may include the tobacco rod 210, and the second portion may include the filter rod 220.

The filter rod 220 may include one or more segments. For example, the filter rod 220 may include a first segment configured to cool an aerosol and a second segment configured to filter a certain component included in the aerosol. Also, as necessary, the filter rod 220 may further include at least one segment configured to perform other functions.

The cigarette 200 may be packaged by at least one wrapper 240. The wrapper 240 may have at least one hole through which external air may be introduced or internal air may be discharged. For example, the cigarette 200 may be packaged by one wrapper 240. As another example, the cigarette 200 may be double-packaged by two or more wrappers 240. For example, the tobacco rod 210 may be packaged by a first wrapper, and the filter rod 220 may be packaged by a second wrapper. Also, the tobacco rod 210 and the filter rod 220, which are respectively packaged by separate wrappers, may be coupled to each other, and the entire cigarette 200 may be packaged by a third wrapper. When each of the tobacco rod 210 or the filter rod 220 is composed of a plurality of segments, each segment may be packaged by separate wrappers. Also, the entire cigarette 200 including the plurality of segments, which are respectively packaged by the separate wrappers and which are coupled to each other, may be re-packaged by another wrapper.

The tobacco rod 210 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 210 may include other additives, such as flavors, a wetting agent, and/or organic acid. Also, the tobacco rod 210 may include a flavored liquid, such as menthol or a moisturizer, which is injected to the tobacco rod 210.

The tobacco rod 210 may be manufactured in various forms. For example, the tobacco rod 210 may be formed as a sheet or a strand. Also, the tobacco rod 210 may be formed as a pipe tobacco, which is formed of tiny bits cut from a tobacco sheet. Also, the tobacco rod 210 may be surrounded by a heat conductive material. For example, the heat-conducting material may be, but is not limited to, a metal foil such as aluminum foil. For example, the heat conductive material surrounding the tobacco rod 210 may uniformly distribute heat transmitted to the tobacco rod 210, and thus, the heat conductivity applied to the tobacco rod may be increased and taste of the tobacco may be improved. Also, the heat conductive material surrounding the tobacco rod 210 may function as a susceptor heated by the induction heater. Here, although not illustrated in the drawings, the tobacco rod 210 may further include an additional susceptor, in addition to the heat conductive material surrounding the tobacco rod 210.

The filter rod 220 may include a cellulose acetate filter. Shapes of the filter rod 220 are not limited. For example, the filter rod 220 may include a cylinder-type rod or a tube-type rod having a hollow inside. Also, the filter rod 220 may include a recess-type rod. When the filter rod 220 includes a plurality of segments, at least one of the plurality of segments may have a different shape.

The filter rod 220 may be formed to generate flavors. For example, a flavoring liquid may be injected onto the filter rod 220, or an additional fiber coated with a flavoring liquid may be inserted into the filter rod 220.

Also, the filter rod 220 may include at least one capsule 230. Here, the capsule 230 may perform a function of generating a flavor or an aerosol. For example, the capsule 230 may have a configuration in which a liquid containing a flavoring material is wrapped with a film. For example, the capsule 230 may have a spherical or cylindrical shape, but is not limited thereto.

When the filter rod 220 includes a segment configured to cool the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above-described example and is not limited as long as the cooling segment cools the aerosol.

Meanwhile, although not illustrated in FIG. 3, the cigarette 200 according to an embodiment may further include a front-end filter. The front-end filter may be located on one side of the tobacco rod 210 which is opposite to the filter rod 220. The front-end filter may prevent the tobacco rod 210 from being detached outwards and prevent the liquefied aerosol from flowing from the tobacco rod 210 into the aerosol generating device (100 of FIGS. 1 and 2), during smoking.

FIG. 4 is a vertical cross-sectional view of an aerosol generating device according to an embodiment, and FIG. 5 is a vertical cross-sectional view of an aerosol generating device according to another embodiment.

Referring to FIGS. 4 and 5, an aerosol generating device 1000 according to the embodiments may include an aerosol generating material reservoir 1100, an atomizer 1200, and an airflow passage 1300. Also, the aerosol generating device 1000 may further include a housing 1500, a processor 1600, and a battery 1700.

FIGS. 4 and 5 illustrate some components of the aerosol generating device 1000. However, it will be understood by those skilled in the art that other components may be further included in the aerosol generating device 1000 according to embodiments.

The aerosol generating material reservoir 1100 may store the aerosol generating material and may provide the aerosol generating material to the atomizer 1200 when the aerosol generating device 1000 is used. The aerosol generating material may be a liquid composition (e.g., a liquid including a tobacco-containing material) as described above with reference to FIGS. 1 and 2.

The aerosol generating material reservoir 1100 may be a space partitioned inside the aerosol generating device 1000 such that the aerosol generating material such as a liquid composition is injected and stored therein. Also, the aerosol generating material reservoir 1100 may be provided in the form of a cartridge that is detachable from a main body of the aerosol generating device 1000.

The aerosol generating material reservoir 1100 may have various shapes. For example, the aerosol generating material reservoir 1100 may have a hollow shape positioned to surround the airflow passage or may have a cylindrical shape positioned adjacent to the airflow passage 1300. However, the shape of the aerosol generating material reservoir 1100 is not limited thereto, and according to an embodiment, the aerosol generating material reservoir 1100 may be formed in an approximately spherical shape, a hemispherical shape, a truncated cone shape, or a polygonal shape including an inner space in which the aerosol generating material may be stored.

The atomizer 1200 may atomize the aerosol generating material by applying energy. The energy generated from the atomizer 1200 may be, for example, thermal energy or vibration energy. The atomizer 1200 may receive the aerosol generating material from the aerosol generating material reservoir 1100 and atomize the aerosol generating material.

For example, the atomizer 1200 may be connected to the aerosol generating material reservoir 1100 by an absorber (e.g., a wick). The atomizer 1200 may receive the aerosol generating material continuously through the absorber, and may heat or vibrate the aerosol generating material to generate aerosol in response to a user's puff.

FIGS. 4 and 5 illustrate embodiments in which the atomizer 1200 is positioned outside the aerosol generating material reservoir 1100. However, in another embodiment, the atomizer 1200 may be positioned inside the aerosol generating material reservoir 1100 and may operate as one module together with the aerosol generating material reservoir 1100. For example, the module in which the atomizer 1200 and the aerosol generating material reservoir 1100 are combined may be the vaporizer or cartridge in FIG. 1 and FIG. 2.

The atomizer 1200 may be in fluid communication with the airflow passage 1300 which will be described later. The aerosol generated by the atomizer 1200 may be mixed with external air (hereinafter, referred to as "outside air") introduced into the aerosol generating device 1000 from the outside of the aerosol generating device 100, and then the aerosol may be discharged to the outside of the aerosol generating device 1000 through the airflow passage 1300.

The airflow passage 1300 may be in fluid communication with the atomizer 1200 as well as the outside of the aerosol generating device 1000, such that the outside air and the aerosol may move through the airflow passage 1300. That is, the airflow passage 1300 may include a passage (e.g., discharge passage 1320) through which the aerosol generated by the aerosol generating device 1000 is discharged to the outside, and a passage (e.g., inflow passage 1310) through which the outside air is introduced into the aerosol generating device 1000.

Referring to FIGS. 4 and 5, the airflow passage 1300 may include an inflow passage 1310 and a discharge passage 1320.

In an embodiment, the inflow passage 1310 may extend from an inflow hole 1311 connected to the outside of the aerosol generating device 1000 to the inside of the aerosol generating device 1000. For example, the outside air may flow into the inflow passage 1310 through the inflow hole 1311 and then may move or flow to the inside of the aerosol generating device 1000 along the inflow passage 1310.

In an embodiment, the discharge passage 1320 may extend from the inside of the aerosol generating device 1000 to a discharge hole 1321. For example, the outside air introduced into the aerosol generating device 1000 may move or flow toward the discharge hole 1321 along the discharge passage 1320.

In other words, the airflow passage 1300 may form a flow path of the outside air in the aerosol generating device 1000, by providing fluid communication between the inflow hole 1311 and the discharge hole 1321 through the inflow passage 1310 and the discharge passage 1320.

According to an embodiment, a plurality of inflow passages 1310 may be positioned to surround the discharge passage 1320 that is approximately in the center of the aerosol generating device 1000, as shown in FIG. 4. However, the structure of the inflow passage 1310 is not limited thereto.

According to another embodiment, as shown in FIG. 5, one inflow passage 1310 may be positioned next to the discharge passage 1320 that is positioned near the center of the aerosol generating device 1000.

When the user inhales on the aerosol generating device 100, the outside air may be introduced to the inside of the aerosol generating device 1000 through the inflow passage 1310, and the aerosol mixed with the outside air may be discharged to the outside of the aerosol generating device 1000 through the discharge passage 1320.

The aerosol generating device 1000 according to an embodiment may include a passage wall 1400. The passage wall 1400 may define at least a portion of the airflow passage 1300 and physically separate the inflow passage 1310 and the discharge passage 1320.

For example, assuming a structure in which a smaller cylindrical tube is inserted into a larger cylindrical tube, the space inside the small cylindrical tube may correspond to the discharge passage 1320, and the space between the large cylindrical tube and the small cylindrical tube may correspond to the inflow passage 1310.

In this case, the small cylindrical tube that partitions the space into the inflow passage 1310 and the discharge passage 1320 may correspond to the passage wall 1400. However, this is just an example for a simplified description of the passage wall 1400, and it will be understood by those skilled in the art that the passage wall 1400 may have various structures and shapes.

One end 1410 (i.e., downstream end) of the passage wall 1400 may be positioned adjacent to the outside of the aerosol generating device 1000, and the other end 1420 (i.e., upstream end) of the passage wall 1400 may be positioned adjacent to the atomizer 1200.

FIGS. 4 and 5 illustrate that the passage wall 1400 extends in a straight line, but the passage wall 1400 may have a curved shape or an angled shape according to embodiments.

For example, unlike in the U-shaped airflow passage 1300 shown in FIG. 4, when the inflow hole 1311 is positioned on the side of the housing 1500 and the discharge hole 1321 is positioned on the downstream end of the aerosol generating device 1000, the passage wall 1400 may form an L-shaped airflow passage 1300. That is, the passage wall 1400 may be implemented in various structures according to positions and shapes of the inflow passage 1310 and the discharge passage 1320, and embodiments are not limited to the shown structure.

The naming of the inflow passage 1310 and the discharge passage 1320 is only for convenience of description of the embodiments, and air and/or aerosol may move in another direction according to a physical condition (e.g., pressure gradient), regardless of the names. For example, when the user does not inhale, the air and the aerosol present in the aerosol generating device 1000 may move to the outside of the aerosol generating device 1000 along the inflow passage 1310.

The housing 1500 may form the overall appearance of the aerosol generating device 1000, and may accommodate the aerosol generating material reservoir 1100, the atomizer 1200, the airflow passage 1300, a processor 1600, and a battery 1700 to protect the components from an external impact.

According to an embodiment, the aerosol generating device 1000 may include the housing 1500 including the inflow hole 1311 through which the outside air flows in, and the discharge hole 1321 through which the aerosol generated by the atomizer 1200 is discharged to the outside. For example, the airflow passage 1300 may be a passage connected from the inflow hole 1311 to the discharge hole 1321.

Here, the inflow hole 1311 and/or the discharge hole 1321 may be a hole formed in the housing 1500 or may be a gap formed between elements of the housing 1500.

According to an embodiment, the aerosol generating device 1000 may further include a mouthpiece. One end of the mouthpiece may come into contact with the user's mouth, and the other end of the mouthpiece may be placed in the discharge passage 1320 so that the aerosol in the discharge passage 1320 may be discharged to the outside through the mouthpiece when the user inhales.

The mouthpiece may be manufactured integrally with the housing 1500 or may be a separate configuration that is detachable from the housing 1500.

The processor 1600 may be electrically connected to the atomizer 1200, the battery 1700, and various sensors (not shown) so that the processor 1600 may receive and transmit signals and control operations of the components. For example, the processor 1600 may control the operation of the atomizer 1200 according to a preset control algorithm to adjust the amount of atomization.

Also, the processor 1600 may detects user's puffs through a puff detection sensor (not shown) and may control the operating time and intensity of the atomizer 1200 accordingly. A detailed description thereof will be provided later with reference to FIG. 8.

The battery 1700 may supply power required for the operation of the aerosol generating device 1000. For example, the battery 1700 may supply power required for the operations of the processor 1600, the atomizer 1200, and various sensors (not shown).

A more detailed description of a general configuration included in the aerosol generating device 1000 will be provided later with reference to FIG. 11.

FIGS. 6A and 6B are enlarged cross-sectional views illustrating an airflow passage so as to describe the flow of airflow in the aerosol generating device according to the embodiment shown in FIG. 4.

FIGS. 6A and 6B illustrate the aerosol generating material reservoir 1100, the airflow passage 1300, and the atomizer 1200 included in the aerosol generating device 1000 according to an embodiment.

The airflow passage 1300 may include an inflow passage 1310 in which the outside air flows toward the atomizer 1200, and a discharge passage 1320 in which the air and the aerosol to the outside of the aerosol generating device 1000. The passage wall 1400 may serve to divide the airflow passage 1300 into the inflow passage 1310 and the discharge passage 1320.

According to an embodiment, the passage wall 1400 may have a hollow shape in which the discharge passage 1320 is formed. In detail, the discharge passage 1320 may be surrounded by the passage wall 1400, and the inflow passage 1310 may be positioned between at least a portion of the passage wall 1400 and another component of the aerosol generating device 1000.

As shown in FIGS. 6A and 6B, the passage wall 1400 may have a cylindrical structure including a cavity, and the inflow passage 1310 may be formed in a space between the outer wall 1110 of the aerosol generating material reservoir 1100 and the passage wall 1400. The discharge passage 1320 may be formed in an inner space of the passage wall 1400.

In this case, the outer wall 1110 of the aerosol generating material reservoir 1100 may correspond to the above-mentioned another component of the aerosol generating device 1000. Here, the outer wall 1110 may mean an outer surface of the aerosol generating material reservoir 1100. Also, although not illustrated, at least a portion of the outer wall 1110 may have a curved shape.

The aerosol generating device 1000 according to an embodiment may further include an atomization space 1360. The atomization space 1360 may mean a space in which the aerosol is ejected from the atomizer 1200. The aerosol generated by the atomizer 1200 may move to the atomization space 1360, may be mixed with the outside air introduced through the inflow passage 1310, and may be discharged to the outside of the aerosol generating device 1000 through the discharge passage 1320.

The atomizer 1200 may atomize the aerosol generating material into an aerosol by heating the aerosol generating material at approximately 150° C. to 250° C. The atomized aerosol may be mixed with the outside air, and its temperature may be lowered to approximately 50° C. to 70° C.

As the temperature falls, the aerosol may be liquefied and/or agglomerated before the aerosol is discharged to the outside of the aerosol generating device 1000. Since the liquefied and/or agglomerated aerosol has adhesiveness, the aerosol may be adhered or accumulated in the atomization space 1360 and the airflow passage 1300. Thus, the durability of the aerosol generating device 1000 and the user's smoking satisfaction and convenience may be reduced.

That is, allowing the aerosol to be quickly discharged before being liquefied inside the aerosol generating device 1000 may improve durability of the aerosol generating device 1000 and the user's smoking satisfaction.

Hereinafter, a structure in which the aerosol generated in the atomization space 1360 is more quickly discharged to the outside of the aerosol generating device 1000 so that the liquefied aerosol may be prevented from being adhered or accumulated inside the aerosol generating device 1000, will be described.

The aerosol generating device 1000 may include at least one Coanda surface on which the fluid (e.g., introduced outside air, aerosol) inside the aerosol generating device 1000 is guided to the outside of the aerosol generating device 1000.

According to an embodiment, the aerosol generating device 1000 may include a first Coanda surface 1430 protruding from at least a region of the passage wall 1400 in a direction toward the discharge passage 1320. The term "Coanda surface" refers to a convex surface that guides the aerosol to the outside by using the Coanda effect. Here, the Coanda effect that refers to a tendency of a fluid to move along a curved surface rather than continue traveling in a straight line.

In detail, the aerosol generating device 1000 may include a first Coanda surface 1430 protruding from the passage wall 1400 toward the discharge passage 1320. For example, the first Coanda surface 1430 may protrude from the upstream end 1420 of the passage wall 1400 in a direction toward the discharge passage 1320.

For example, the first Coanda surface 1430 may be convexly protruding or curved by a certain curvature.

Referring to FIG. 6A, according to the user's inhalation of the discharge passage 1320, the outside air may be introduced into the inflow passage 1310 through the inflow hole 1311 and may move to the atomization space 1360. The introduced air may be mixed with the aerosol in the atomization space 1360.

Referring to FIG. 6B, when the aerosol mixed with the outside air moves to the inside of the discharge passage 1320, the Coanda effect may occur on the Coanda surface. That is, the aerosol generated in the atomizer 1200 may be guided toward the discharge passage 1320 by the first Coanda surface 1430 according to the Coanda effect. As a result, the aerosol may move along the surface of the discharge passage 1320, and the discharge flow of the aerosol may be accelerated or enhanced.

Also, the aerosol generating device 1000 may include a discharge passage 1320 which becomes larger along the discharge direction of the generated aerosol. For example, a cross-sectional area A1 of an inlet 1323 of the discharge passage 1320 may be smaller than a cross-sectional area A2 of a middle portion 1322 of the discharge passage 1320.

It is known that the Coanda effect may occur more effectively in high-velocity fluids (e.g., jet flow). The discharge passage 1320 having the above-mentioned structure accelerates the flow of the aerosol at the inlet 1323, thereby reinforcing the Coanda effect and consequently the discharge flow of the aerosol may be accelerated.

In addition, the aerosol generating device 1000 may include an inflow passage 1310 which becomes narrower along a direction in which the outside air is introduced. For example, a cross-sectional area A3 of a portion 1313 near the atomization space 1360 may be smaller than a cross-sectional area A4 of a portion 1312 near the inflow hole 1311. Thus, the flow of the aerosol moving toward the first Coanda surface 1430 from the inflow passage 1310 may be accelerated so that the Coanda effect may be reinforced.

Also, it is known that the Coanda effect may occur more effectively on a curved surface than on a flat surface. Thus, when the first Coanda surface 1430 has a convex shape, the aerosol generated by the atomizer 1200 may be more quickly discharged to the outside of the aerosol generating device 1000.

According to the above-described embodiments, the aerosol generated by the atomizer 1200 may move along the first Coanda surface 1430 in the airflow passage 1300 and may be quickly discharged to the outside of the aerosol generating device 1000. Thus, liquefaction of the aerosol and accumulation of the liquefied aerosol inside the aerosol generating device 100 may be prevented.

FIG. 7 is an enlarged cross-sectional view of an aerosol generating device according to another embodiment.

Referring to FIG. 7, an aerosol generating device 1000 according to another embodiment may include an aerosol generating material reservoir 1100, an atomizer 120, and a first Coanda surface 1430 and a second Coanda surface 1440, which are formed on a passage wall 1400.

Some components of the aerosol generating device 1000 according to the present embodiment may be the same as or similar to those of the aerosol generating device 1000 shown in FIGS. 4 and 5, and hereinafter, a redundant description thereof will be omitted.

The aerosol generating device 1000 according to the present embodiment may further include a second Coanda surface 1440 protruding from the inner surface of the passage wall 1400 toward the discharge passage 1320. As shown in FIG. 7, the second Coanda surface 1440 may be apart from the first Coanda surface 1430.

The second Coanda surface 1440 may be located downstream of the first Coanda surface 1430 with respect to the discharge direction of the aerosol. The second Coanda surface 1440 may be a curved surface protruding in the inner direction of the discharge passage 1320.

The second Coanda surface 1440 may accelerate the flow of the airflow moving downstream in the discharge passage 1320. By the second Coanda surface 1440 is added, the Coanda effect may be reinforced, and the aerosol in the discharge passage 1320 may be more quickly discharged.

Referring to FIG. 7, the second Coanda surface 1440 is only formed in an approximately middle of the discharge passage 1320. However, this is just an example, and a plurality of second Coanda surfaces 1440 may be formed to be spaced apart from each other by a certain distance along the longitudinal direction of the discharge passage 1320. That is, the position and the number of second Coanda surfaces 1440 are not limited to the illustrated example.

Also, the discharge passage 1320 may become narrower along a direction in which the aerosol is discharged. For example, a cross-sectional area (e.g., A5) of a downstream portion of the discharge passage 1320 may be smaller than a cross-sectional area (e.g., A6) of an upstream portion of the discharge passage 1320. Thus, the flow of the aerosol moving toward the second Coanda surface 1440 may be accelerated so that the Coanda effect may be reinforced and the discharge flow of the aerosol may be accelerated.

FIG. 8 is an enlarged cross-sectional view of an aerosol generating device according to another embodiment.

Referring to FIG. 8, an aerosol generating device 1000 according to an embodiment may include an aerosol generating material reservoir 1100, an atomizer 1200, and a first Coanda surface 1430 and a third Coanda surface 1450, which are formed on the passage wall 1400. Hereinafter, a redundant description with the description of FIGS. 4 and 5 will be omitted.

Even when the aerosol generating device 1000 is not in use, the aerosol may be generated by the residual heat in the atomizer 1200. The aerosol generated by the residual heat may be liquefied in the aerosol generating device 1000 and may be adhered to the atomization space 1360 and the airflow passage 1300. In this respect, the fluid (or aerosol) in the aerosol generating device 1000 needs to be guided to the outside.

The aerosol generating device 1000 according to the present embodiment may include a third Coanda surface 1450 protruding in a direction toward the inflow passage 1310 from at least one region of the passage wall 1400.

In detail, the aerosol generating device 1000 may include the third Coanda surface 1450 protruding in a direction toward the inside of the inflow passage 1310 from the upstream end 1420 of the passage wall 1400. For example, the first Coanda surface 1430 and the third Coanda surface 1450 may protrude in an opposite directions from the passage wall 1400.

Referring to FIG. 8, the third Coanda surface 1450 is only formed at a position where the inflow passage 1310 meets the atomization space 1360. However, this is just an example, and according to another embodiment, a plurality of third Coanda surfaces 1450 may be formed inside the inflow passage 1310 to be spaced apart from each other by a certain distance along a direction in which the inflow passage 1310 extends. That is, the position and the number of third Coanda surfaces 1450 are not limited to the illustrated embodiment.

Referring to FIG. 8, the flow of the aerosol generated by the residual heat is shown.

The third Coanda surface 1450 together with the first Coanda surface 1430 may allow the residual aerosol to be guided to the outside of the aerosol generating device 100 through the airflow passage 1300.

That is, even when the user of the aerosol generating device 1000 does not inhale, the aerosol in the atomization space 1360 may be guided to the discharge passage 1320 along the first Coanda surface 1430, and to the inflow passage 1310 along the third Coanda surface 1450. Thus, the aerosol generated by the residual heat may be discharged to the outside of the aerosol generating device 1000.

In this way, even without an artificial or forced (e.g. user's inhalation) pressure gradient, the first Coanda surface 1430 and the third Coanda surface 1450 may induce the discharge flow of the aerosol so that the aerosol generated by the residual heat may be discharged to the outside of the aerosol generating device 1000.

FIG. 9 is an enlarged view of a mesh net arranged in an aerosol generating device according to an embodiment.

Referring to FIG. 9, the aerosol generating device 1000 according to an embodiment may include an aerosol generating material reservoir 1100, an atomizer 1200, an airflow passage 1300, and a mesh net M. FIG. 9 may be an embodiment in which the mesh net M is added to the aerosol generating device 1000 shown in FIG. 4, and hereinafter, a redundant description therewith will be omitted.

As described above, a portion of the aerosol that stays in the aerosol generating device 1000 for a relatively long time may be liquefied in the airflow passage 1300. When the user inhales the liquefied aerosol, the user's smoking satisfaction may be lowered and thus, the discharge of the liquefied aerosol needs to be prevented.

According to an embodiment, the aerosol generating device 1000 may further include the mesh net M, and the mesh net M may be arranged in one region of the airflow passage 1300. For example, the mesh net M may be arranged in the inflow passage 1310 or the discharge passage 1320. Also, the mesh net M may be attached to at least one region of the passage wall 1400. However, embodiments are not limited thereto.

As shown in FIG. 9, the mesh net M may include a plurality of holes m penetrating the mesh net M. The mesh net M may prevent an liquefied aerosol A having a size greater than or equal to a certain size from being discharged to the outside of the aerosol generating device 1000 through the airflow passage 1300.

The diameter of the hole m penetrating the mesh net M may be, for example, 0.2 μm to 15 μm. Assuming that the diameter is 15 μm, an aerosol having a diameter less than or equal to 15 μm may be discharged to the outside of the aerosol generating device 1000. However, in this case, liquefied aerosol having a diameter greater than 15 μm may be prevented from being discharged to the outside of the aerosol generating device 1000.

FIG. 10 is a cross-sectional view of an aerosol generating device according to another embodiment.

Referring to FIG. 10, an aerosol generating device 1000 according to another embodiment may include an aerosol generating material reservoir 1100, an atomizer 1200, an airflow passage 1300, a processor 1600, a battery 1700, a heating member 1800, and a puff detection sensor 1900.

The aerosol generating device 1000 of FIG. 10 may be an embodiment in which the heating member 1800 and the puff detection sensor 1900 are added to the aerosol generating device 1000 of FIG. 4. Therefore, a redundant description therewith will be omitted.

The heating member 1800 may be arranged on the passage wall 1400 and may apply heat to the fluid or aerosol present in the aerosol generating device 1000. For example, the heating member 1800 may be arranged at a certain region (e.g., a middle region) of the passage wall 1400 and may apply heat to the aerosol flowing along the discharge passage 1320.

Specifically, the heating member 1800 may heat the airflow passing through the airflow passage 1300 and the aerosol adhered to the airflow passage 1300, thereby promoting the movement or discharge of the aerosol.

That is, the heating member 1800 may vaporize the adhered aerosol again or atomize the agglomerated aerosol so that the aerosol is discharged to the outside of the aerosol generating device 1000.

Referring to FIG. 10, the heating member 1800 has a shape of a coil installed inside the passage wall 1400 at an approximately middle region of the passage wall 1400. However, embodiments are not limited to the shape and structure. For example, the heating member 1800 may be wound on the surface of the passage wall 1400, may have a plate shape or cylindrical shape, or may be arranged on the upstream end or downstream end of the passage wall 1400.

The heating member 1800 may be an electric resistive heater or an induction heater. However, embodiments are not limited to a certain heating method.

The puff detection sensor 1900 may detect the user's inhalation on the aerosol generating device 1000. Referring to FIG. 10, the puff detection sensor 1900 may be arranged on the passage wall 1400. However, embodiments are not limited thereto, and the puff detection sensor 1900 may be arranged at another position where a change of airflow may be detected.

The processor 1600 may be electrically connected to the heating member 1800 and the puff detection sensor 1900 so that the processor 1600 may control operation of the heating member 1800 based on a signal detected by the puff detection sensor 1900. In detail, the processor 1600 may receive the user's puff signal from the puff detection sensor 1900 and may control the heating member 1800 to be heated for a certain time after receiving the puff signal. For example, the heating temperature of the heating member 1800 may be approximately 50° C. to 80° C., and the certain time may be 5 seconds. The heating temperature and the heating time may be changed according to user's As the heating member 1800 is further included in the aerosol generating device 1000, the airflow passage 1300 may be maintained at a certain temperature when the aerosol generating device 1000 is used. Thus, the discharge of the aerosol may be accelerated.

In addition, even when the use of the aerosol generating device 1000 is terminated, the airflow passage 1300 may be maintained in the heated state for a certain time. As a result, the aerosol may be prevented from being liquefied inside the aerosol generating device 1000 and the liquefied aerosol may be prevented from being adhered to or accumulated in the airflow passage 1300.

In addition, an aerosol generating article 2000 may be inserted into the aerosol generating device 1000. The aerosol generating article 2000 may be, for example, a cigarette described above with reference to FIGS. 1 through 3.

The aerosol generating article 2000 may be formed to have a shape corresponding to the discharge passage so that the aerosol generating article 2000 may be inserted into the aerosol generating device 1000. The user may contact a portion of the aerosol generating article 2000 with his/her mouth. When the user inhales on the aerosol generating article 2000, the aerosol generated in the atomizer 1200 may pass through the aerosol generating article 2000. While passing through the aerosol generating article 2000, the aerosol may be mixed with another aerosol generated from the aerosol generating article 2000 so that the mixed aerosol may be discharged.

The aerosol generating article 2000 may include the same material as the aerosol generating material included in the aerosol generating material reservoir 1100, but it may include a different material. For example, a flavor element may be included in the aerosol generating article 2000 so that a flavor may be added to the aerosol generated by the atomizer 1200 while the aerosol passes through the aerosol generating article 2000.

The heating member 1800 may also heat the aerosol generating article 2000 inserted into the aerosol generating device 1000. For example, the heating member 1800 may correspond to the heater described with reference to FIGS. 1 and 2.

FIG. 11 is a block diagram of an aerosol generating device according to an embodiment.

Referring to FIG. 11, an aerosol generating device 1000 may include a battery 1010, an atomizer 1020, a sensor 1030, a user interface 1040, a memory 1050, and a processor 1060. However, the internal structure of the aerosol generating device 1000 is not limited to the illustration of FIG. 11. It will be understood by those skilled in the art that according to the design of the aerosol generating device 1000, some of hardware components illustrated in FIG. 11 may be omitted or a new configuration may be further included.

In an embodiment, the aerosol generating device 1000 may include a main body. In this case, hardware components included in the aerosol generating device 1000 may be positioned in the main body.

In another embodiment, the aerosol generating device 1000 may include a main body and a cartridge. Hardware components included in the aerosol generating device 1000 may be located in the main body and/or the cartridge. Alternatively, at least a portion of the hardware components included in the aerosol generating device 1000 may be located in each of the main body and the cartridge.

Hereinafter, the operation of each element will be described without limiting the space in which each of elements included in the aerosol generating device 1000 is located.

The battery 1010 may supply power used to operate the aerosol generating device 1000. That is, the battery 1010 may supply power so that the atomizer 1020 may atomize the aerosol generating material. In addition, the battery 1010 may supply power required for the operations of other hardware components included in the aerosol generating device 1000, i.e., the sensor 1030, the user interface 1040, the memory 1050, and the processor 1060. The battery 1010 may be a rechargeable battery or a disposable battery.

For example, the battery 1010 may include a nickel-based battery (e.g., a nickel-metal hydride battery, a nickel-cadmium battery), or a lithium-based battery (e.g., a lithium-cobalt battery, a lithium-phosphate battery, a lithium titanate battery, a lithium-ion battery or a lithium-polymer battery). However, the type of the battery 1010 that may be used in the aerosol generating device 1000 is not limited to the above description. If necessary, the battery 1010 may include an alkaline battery, or a manganese battery.

The atomizer 1020 may receive power from the battery 1010 according to the control of the processor 1060. The atomizer 1020 may atomize the aerosol generating material stored in the aerosol generating device 1000 by receiving power from the battery 1010.

The atomizer 1020 may be located in the main body of the aerosol generating device 1000. Alternatively, when the aerosol generating device 1000 includes the main body and the cartridge, the atomizer 1020 may be located in the cartridge or may be located in the main body and/or the cartridge. When the atomizer 1020 is located in the cartridge, the atomizer 1020 may receive power from the battery 1010 located in at least one of the main body and the cartridge.

Also, when the atomizer 1020 is located in each of the main body and the cartridge, components of the atomizer 1020 that require the supply of power may receive power from the battery 1010 located in at least one of the main body and the cartridge.

The atomizer 1020 may generate an aerosol from an aerosol generating material inside the cartridge. The aerosol means a suspension in which liquid and/or solid fine particles are dispersed in a gas. Thus, the aerosol generated by the atomizer 1020 may mean a state in which vaporized particles generated from the aerosol generating material and the air are mixed with each other.

For example, the atomizer 1020 may convert the phase of the aerosol generating material into a gas phase through vaporization and/or sublimation. Also, the atomizer 1020 may generate an aerosol by atomizing and emitting the aerosol generating material in a liquid and/or solid phase.

For example, the atomizer 1020 may generate an aerosol from the aerosol generating material by using an ultrasonic vibration method. The ultrasonic vibration method may mean a method, whereby an aerosol generating material is atomized through ultrasonic vibration generated by a vibrator, so as to generate an aerosol.

Although not shown in FIG. 11, the atomizer 1020 may optionally include a heater for heating the aerosol generating material. The aerosol generating material may be heated by the heater. As a result, an aerosol may be generated.

The heater may be formed of an arbitrary appropriate electric resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. Also, the heater may be implemented with a metal heating wire, a metal heating plate on which an electrically conductive track is disposed, a ceramic heating body, or the like. However, embodiments are not limited thereto.

For example, in an embodiment, the heater may be a portion of the cartridge, and the heater may be included in the main body of the aerosol generating device. Also, the cartridge may include a reservoir and/or an absorber, and/or the main body may include a receiver and/or an absorber.

For example, the aerosol generating material accommodated in the receiver may move to the absorber, and the heater may heat the aerosol generating material absorbed by the absorber to generate an aerosol. For example, the heater may be wound on the absorber or may be located adjacent to the absorber.

The heater may be an induction heater. The heater may include an electrically conductive coil for heating the aerosol generating material by using an induction heating method, and a susceptor that may be heated by the induction heater may be included in the cartridge and/or the main body.

The aerosol generating device 1000 may include at least one sensor 1030. The result sensed by at least one sensor 1030 may be transferred to the processor 1060. According to the sensing result, the processor 1060 may control the aerosol generating device 1000 so that various functions such as controlling the operation of the atomizer 1020, restriction of smoking, determining whether a cartridge (or a cigarette) is inserted or not, displaying of notification, and the like may be performed.

For example, at least one sensor 1030 may include a puff detection sensor. The puff detection sensor may detect the user's puff based on at least one of a change of a flow rate of airflow introduced from the outside, a change of pressure, and detection of a sound. The puff detection sensor may detect a start timing and an end timing of the user's puff, and the processor 1060 may determine a puff period and a non-puff period according to the determined start timing and end timing.

Also, at least one sensor 1030 may include a user input sensor. The user input sensor may be a sensor that may receive the user's input, such as a switch, a physical button, a touch sensor, or the like. For example, the touch sensor may be a capacitive sensor that, when the user touches a certain region formed of a metal material, a change in capacitance occurs and that detects the change in capacitance, thereby detecting the user's input. The processor 1060 may determine whether the user's input has occurred by comparing values before and after the change in capacitance received from the capacitive sensor occurs. When the values before and after the change in capacitance exceed a pre-set threshold value, the processor 1060 may determine that the user's input has occurred.

Also, at least one sensor 1030 may include a consumable detachment sensor that may detect installation or removal of consumables (for example, a cartridge, a cigarette, and the like) that may be used in the aerosol generating device 1000. For example, the consumable detachment sensor may determine whether the consumables are in contact with the aerosol generating device 1000 or whether the consumables are removed by an image sensor. Also, the consumable detachment sensor may be an inductance sensor that detects a change in inductances of a coil that may interact with markers of the consumables, or a capacitance sensor that detects a change in capacitances of a capacitor that may interact with the markers of the consumables.

Also, at least one sensor 1030 may include a temperature sensor. The temperature sensor may detect temperature at which a heater (or an aerosol generating material) of the atomizer 1020 is heated. The aerosol generating device 1000 may include a separate temperature sensor for detecting the temperature of the heater, or the heater itself may function as a temperature sensor instead of a separate temperature sensor. Alternatively, the heater may function as the temperature sensor, and simultaneously, a separate temperature sensor may be further included in the aerosol generating device 1000. Also, the temperature sensor may detect the temperature of internal components, such as a printed circuit board (PCB) of the aerosol generating device 1000, a battery, and the like, as well as the heater.

Also, at least one sensor 1030 may include various sensors for measuring information about an ambient environment of the aerosol generating device 1000. For example, at least one sensor 1030 may include a temperature sensor for measuring the temperature of the ambient environment, a humidity sensor for measuring the humidity of the ambient environment, an atmospheric sensor for measuring the pressure of the ambient environment, and the like.

The sensor 1030 that may be provided in the aerosol generating device 1000 is not limited to the above-described type and may further include various sensors.

Only some of the examples of various sensors 1030 illustrated above may be optionally selected and implemented in the aerosol generating device 1000. In other words, the aerosol generating device 1000 may be utilized by combining pieces of information sensed by at least one sensor among the above-described sensors.

The user interface 1040 may provide information about the state of the aerosol generating device 1000 to the user. The user interface 1040 may include various interfacing units, such as a display or lamp for outputting visual information, a motor for outputting tactile information, a speaker for outputting sound information, terminals for performing data communication with or receiving charged power from input/output (I/O) interfacing units (e.g., a button or touch screen) for receiving information from the user or outputting information to the user, a communication interfacing module for performing wireless communications (e.g., Wireless Fidelity (Wi-Fi), Wi-Fi Direct, Bluetooth, near-field communication (NFC), and the like) with an external device.

However, only some of various examples of the user interface 1040 illustrated above may be selected and implemented in the aerosol generating device 1000.

The memory 1050 that is hardware for storing various data processed in the aerosol generating device 1000 may store data processed or to be processed by the processor 1060. The memory 1050 may be implemented with various types, such as random access memory (RAM), for example, dynamic random access memory (DRAM), static random access memory, or the like, read-only memory (ROM), electrically erasable programmable read-only memory (EEPROM), and the like.

Data about the operating time of the aerosol generating device 1000, the maximum number of puffs, the current number of puffs, at least one temperature profile, and the user's smoking pattern, may be stored in the memory 1050.

The processor 1060 may control the overall operation of the aerosol generating device 1000. The processor 1060 may be implemented with an array of a plurality of logic gates and may also be implemented with the combination of a general-purpose micro-processor and memory in which a program to be executed by the micro-processor is stored. Also, it will be understood by those skilled in the art that the processor 1060 may be implemented with another type of hardware.

The processor 1060 may analyze the result sensed by at least one sensor 1030 and may control processes to be performed.

The processor 1060 may control power supplied to the atomizer 1020 so that the operation of the atomizer 1020 may start or end based on the result sensed by at least one sensor 1030. Also, the processor 1060 may control the amount of power supplied to the atomizer 1020 and time when power is supplied, so that the atomizer 1020 may generate an appropriate amount of aerosol based on the result sensed by at least one sensor 1030. For example, the processor 1060 may control current or voltage supplied to a vibrator so that the vibrator of the atomizer 1020 may vibrate with a certain frequency.

In an embodiment, the processor 1060 may receive the user's input about the aerosol generating device 1000 and then may start the operation of the atomizer 1020. Also, the processor 1060 may detect the user's puff by using the puff detection sensor and then may start the operation of the atomizer 1020. Also, the processor 1060 may count the number of puffs by using puff detection sensor and then may stop the supply of power to the atomizer 1020 when the number of puffs reaches a pre-set number.

The processor 1060 may control the user interface 1040 based on the result sensed by at least one sensor 1030. For example, when the number of puffs is counted by using the puff detection sensor and then the number of puffs reaches a pre-set number, the processor 1060 may notify that the aerosol generating device 1000 will be ended to the user by using at least one of a lamp, a motor, and a motor.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

The invention claimed is:

1. An aerosol generating device comprising:

an aerosol generating material reservoir configured to store an aerosol generating material;

an atomizer configured to atomize the aerosol generating material into an aerosol and inject the aerosol into an atomization space;

an inflow passage configured to provide fluid communication between outside of the aerosol generating device and the atomization space;

a discharge passage which is surrounded by a passage wall and through which air introduced from the outside through the inflow passage and the aerosol are discharged out of the aerosol generating device; and at least one convex surface configured to guide the aerosol to the outside of the aerosol generating device by Coanda effect, the at least one convex surface comprising a first convex surface protruding toward the discharge passage from the passage wall and being a curved shape, wherein the atomization space is upstream of the first convex surface.

2. The aerosol generating device of claim 1, wherein
the passage wall extends in a longitudinal direction of the aerosol generating device, and
the first convex surface is formed at an upstream end of the passage wall.

3. The aerosol generating device of claim 1, wherein the at least one convex surface further comprises a second convex surface positioned apart from the first convex surface and protruding from the passage wall toward the discharge passage.

4. The aerosol generating device of claim 3, wherein
the passage wall extends in a longitudinal direction of the aerosol generating device, and
the second convex surface is positioned downstream of the first convex surface.

5. The aerosol generating device of claim 1, wherein the at least one convex surface further comprises a third convex surface protruding from the passage wall toward the inflow passage.

6. The aerosol generating device of claim 5, wherein
the passage wall extends in a longitudinal direction of the aerosol generating device, and
the third convex surface is formed at an upstream end of the passage wall.

7. The aerosol generating device of claim 1, wherein
the inflow passage is located between the aerosol generating material reservoir and the passage wall.

8. The aerosol generating device of claim 1, further comprising a housing comprising:
an inflow hole through which the air is introduced into the inflow passage from the outside; and
a discharge hole through which the generated aerosol is discharged.

9. The aerosol generating device of claim 1, further comprising a mouthpiece for contacting a user's mouth, wherein the mouthpiece is in fluid communication with the discharge passage.

10. The aerosol generating device of claim 5, wherein
without user's inhalation, the aerosol generated by the atomizer is guided to the outside of the aerosol generating device along at least one of the first convex surface and the third convex surface.

11. The aerosol generating device of claim 1, further comprising a heating member arranged in the passage wall and configured to heat the aerosol present in the discharge passage.

12. The aerosol generating device of claim 11, further comprising:
a puff detection sensor configured to detect user's inhalation; and
a processor electrically connected to the heating member and the puff detection sensor, and configured to control the heating member to be heated for a certain time based on the user's inhalation being detected by the puff detection sensor.

13. The aerosol generating device of claim 1, wherein the discharge passage is configured to receive an aerosol generating article such that the aerosol generating article is inserted into at least a portion of the discharge passage.

14. The aerosol generating device of claim 13, further comprising a heater located in the discharge passage, and configured to heat the aerosol generating article inserted into the discharge passage.

15. The aerosol generating device of claim 1, further comprising a mesh net located in the discharge passage, and configured to prevent passage of an aerosol particle greater than or equal to a predetermined size.

16. The aerosol generating device of claim 1, wherein the inflow passage extends along a first direction, and the discharge passage extends along a second direction different from the first direction, and
wherein the first convex surface is configured to guide air from the inflow passage along the first direction into the discharge passage along a second direction.

17. The aerosol generating device of claim 1, wherein
the passage wall extends in a longitudinal direction of the aerosol generating device;
the passage wall partitions a space into the inflow passage and the discharge passage,
the passage wall has a hollow shape in which the discharge passage is formed, and
the inflow passage is located between the aerosol generating material reservoir and the passage wall.

18. The aerosol generating device of claim 1, wherein
the passage wall extends in a longitudinal direction of the aerosol generating device from one end of the passage wall to another end of the passage wall,
the first convex surface is formed at the other end of the passage wall and protrudes toward the discharge passage,
the inflow passage extends along one surface of the passage wall, and
the discharge passage extends along the other surface of the passage wall.

* * * * *